US007290422B2

(12) United States Patent
Flehmig et al.

(10) Patent No.: US 7,290,422 B2
(45) Date of Patent: Nov. 6, 2007

(54) DEVICE FOR FREE THREE-DIMENSIONAL PROFILE FORMING

(75) Inventors: Thomas Flehmig, Ratingen (DE); Martin Kibben, Dinslaken (DE)

(73) Assignee: Thyssenkrupp Stahl AG, Duisburg (DE)

( * ) Notice: Subject to any disclaimer, the term of this patent is extended or adjusted under 35 U.S.C. 154(b) by 0 days.

(21) Appl. No.: 10/528,976

(22) PCT Filed: Oct. 8, 2003

(86) PCT No.: PCT/EP03/11118

§ 371 (c)(1),
(2), (4) Date: Mar. 10, 2006

(87) PCT Pub. No.: WO2004/035241

PCT Pub. Date: Apr. 29, 2004

(65) Prior Publication Data

US 2006/0201218 A1 Sep. 14, 2006

(30) Foreign Application Priority Data

Oct. 9, 2002 (DE) ..... 102 46 977

(51) Int. Cl.
*B21D 5/14* (2006.01)

(52) U.S. Cl. ..... 72/166; 72/169

(58) Field of Classification Search ..... 72/166, 72/123, 169, 135, 128, 150, 369
See application file for complete search history.

(56) References Cited

U.S. PATENT DOCUMENTS 4,412,442 A * 11/1983 Kawanami et al. ..... 72/128
5,111,675 A * 5/1992 Murata ..... 72/6.1
6,253,591 B1 * 7/2001 Sayama et al. ..... 72/167

FOREIGN PATENT DOCUMENTS

| | | |
|---|---|---|
| DE | 100 20 727 | 10/2001 |
| EP | 0928645 | 7/1999 |
| EP | 0928646 | 7/1999 |
| EP | 1087278 | 3/2001 |
| JP | 04127919 | 4/1992 |
| JP | 04284923 A * | 10/1992 |
| JP | 8257643 | 10/1996 |

* cited by examiner

*Primary Examiner*—Derris H. Banks
*Assistant Examiner*—Debra Wolfe
(74) *Attorney, Agent, or Firm*—Proskauer Rose LLP

(57) ABSTRACT

The invention pertains to a device for the 3D free-form bending of profiles with arbitrary, but constant outside dimensions over the profile length, particularly hollow profiles, wherein the profile to be bent has a longitudinal axis and is moved through the through-opening-of a guide element adjoining the profile surface and a bending sleeve that is arranged downstream of the guide element referred to the feed direction and held in a carrier element in a feed direction that extends parallel to the longitudinal axis, namely by means of a feed unit that contains a rotary drive. The bending sleeve can be pivoted about an axis that extends perpendicular to the feed direction and displaced perpendicular to the longitudinal axis of the profile. When turning the profile about its longitudinal axis by means of the feed unit, the guide element and the bending sleeve can be turned with the profile.

18 Claims, 3 Drawing Sheets

DEVICE FOR FREE THREE-DIMENSIONAL PROFILE FORMING

BACKGROUND OF THE INVENTION

The invention pertains to a device for the 3D free-form bending of profiles with constant outside dimensions over their length, particularly with a circular shape, wherein said device comprises a feed unit that contains a rotary drive for turning the profile about its longitudinal axis and serves for moving the profile with a longitudinal axis in a feed direction that extends parallel to this longitudinal axis, namely through a guide element with a through-opening that adjoins the surface of the profile and a bending sleeve that at least partially encloses the profile to be bent and is arranged downstream of the guide element referred to the feed direction, wherein said bending sleeve is held in a carrier element and can be pivoted about an axis that extends perpendicular to the feed direction of the profile, as well as displaced perpendicular to the longitudinal axis and the pivoting axis, together with said carrier element such that the bending sleeve acts upon the profile in a bending fashion.

3D free-form bending devices are known from the state of the art. For example, JP 08 257 643 A discloses a 3D profile bending device, in which a profile is moved through a stationary guide element and a bending sleeve that is arranged downstream of the guide element referred to the feed direction and integrated into a carrier element. The carrier element is held in a receptacle frame such that it can be turned about a first axis that extends through the center of the bending sleeve perpendicular to the longitudinal axis of the profile to be bent. The receptacle frame itself is supported such that it can be turned about a second axis of rotation that extends through the center of the bending sleeve, namely perpendicular to the profile axis as well as perpendicular to the first axis. In addition, the receptacle frame can be displaced along both axes. The profile can be bent three-dimensionally by respectively adapting the rotational movement and the displacement of the receptacle frame relative to the rotational movement of the carrier element in the receptacle frame accordingly.

The disadvantage of this bending device is that the different rotational and translational movements of the carrier element and the receptacle frame need to be exactly adapted to one another in order to bend the profile into the desired shape. This not only requires high investment costs, but also a complicated CNC control of the bending device.

EP 0 928 646 A1 discloses another bending device that operates in accordance with the same principle as the above-described device. In addition to the rotational movement about and the translational movement along the respective axes that extend perpendicular to the profile axis and lie orthogonal to one another, the carrier element of this device can also be turned about the longitudinal axis of the profile in order to achieve the desired torsion of the profile during the bending process. Although all degrees of freedom of the bending process are realized with this device, a total of five rotary and linear drives is required in addition to the feed unit, wherein said drives also need to be correspondingly adapted to one another. This means that the drives need to fulfill very high requirements with respect to precision and synchronism, and that this bending device cannot be realized in a cost-efficient fashion.

EP 0 928 645 A1 discloses a simplified variation of a bending device for the 3D free-form bending of profiles. Analogous to the above-described state of the art, the feed unit of this device moves the profile through a non-rotatable guide element and a U-shaped, open bending sleeve arranged downstream thereof. The guide element is inserted into a sleeve that is non-rotatably connected to the machine frame and on which an outer sleeve is rotatably supported. In this case, the axis of rotation of the outer sleeve coincides with the longitudinal axis of the profile. The outer sleeve contains a boom that extends in the feed direction and on the end of which a support element carrying the bending sleeve is arranged such that it can be turned about an axis that extends perpendicular to the feed direction and is laterally offset relative thereto. The position of this axis relative to the bending sleeve is chosen such that the rotational and translational movements of the bending sleeve required for adjusting the desired bending radius can be achieved by means of a single pivoting movement. The three-dimensional bending of the profile is realized by turning the outer sleeve and the open bending sleeve connected thereto about the profile axis by means of the support element and the boom, namely by a certain angle that corresponds to the desired change in the position of the bending plane. Subsequently, the desired bending radius is adjusted once again by turning the bending sleeve accordingly, and the bending process is continued in a new bending plane.

In comparison with the other bending devices described above, this device has a much simpler design that only requires two drives in addition to the feed unit. However, one disadvantage can be seen in the complicated mechanism for turning the bending sleeve by means of the rotatably supported outer sleeve. This makes it impossible to realize this device in a compact fashion. In addition, a frequently undesirable and extensive straight transition section is frequently formed during the phase, in which the device is adjusted from one bending plane to another bending plane. This device is only suitable for profiles that have a circular cross section, namely because the profile needs to be held in the bending sleeve such that it can be axially turned.

Another 3D bending device for bending profiles with a circular cross-sectional shape is known from practical applications, wherein the profile is moved through a non-rotatable guide sleeve that encloses the profile with a positive fit, as well as through a bending sleeve arranged downstream thereof, wherein said bending sleeve is held in a carrier element and also encloses the profile with a positive fit. The rotational and translational movements of the bending sleeve required for adjusting the desired bending radius can be realized due to the fact that the bending sleeve is held in a rocker by the carrier element such that it can be turned perpendicular to the feed direction. In this case, an actuating cylinder is used for turning the bending sleeve by means of a boom. In contrast to the previously described state of the art, the bending plane is not changed by turning the bending sleeve about the longitudinal axis of the profile in this case, but rather by turning the bending sleeve about its longitudinal axis with the aid of a drive integrated into the feed unit. This results in the relative movement between the bending sleeve and the profile to be bent taking place in an unchanged fashion.

These measures make it possible to achieve a more compact design of the bending device than in the previously cited state of the art. Nevertheless, this device is also unsuitable for bending profiles with non-circular cross sections because it must be possible to turn the profile in the guide sleeve as well as in the bending sleeve.

The relevant state of the art also discloses drawing/bending machines for hollow profiles that have become quite popular in the automobile industry. However, these machines are only able to bend profiles in one plane, i.e., 2-dimensionally. A drawing/bending machine for thin-walled metal pipes is described in DE 100 20 727 C1. In this case, the front end of the pipe is clamped in position in a fastening device by means of clamping jaws. When processing thin-walled pipes, the inside of the pipe needs to be supported by a grip head in the clamping region and by a bending block in the bending region. Once the pipe is fastened in the desired position, the bending process is initiated by turning a bending table with a circular shape that defines the attainable bending radius about its axis of rotation. This causes the pipe to be drawn forward and to be simultaneously bent by the bending table. In addition to being limited to bending processes in only one plane, the fundamental disadvantage of such drawing/bending machines can be seen in the fact that no variable radii and no bending about the longitudinal axis of the profile can be realized.

SUMMARY OF THE INVENTION

The invention is based on the objective of developing a device that has a simple design and allows the 3D free-form bending of profiles with a constant outside contour over their length, for example, a circular contour, an oval contour or the contour of a regular polygon, etc.

According to the invention, this objective is attained with a device of the initially described type in that a) the profile is supported such that it can be turned about the longitudinal axis in or with the guide element, b) the profile is supported such that it can be turned about the longitudinal axis in or with the bending sleeve, c) the bending,sleeve is supported such that it can be eccentrically pivoted about a first hinge point of a rocker by means of the carrier element, wherein the rocker, in turn, is supported such that it can be pivoted about a second hinge point that is arranged eccentric to the longitudinal axis of the profile on the same side of the profile as the first hinge point, and d) the carrier element is held in a guide groove on the opposite side of the profile referred to the hinge points, namely such that the inner surface region of the bending sleeve that acts upon the outside of the profile in a bending fashion is, discounting the resilience of the profile, always aligned tangential referred to a circular arc that corresponds to the respectively desired bending radius when the position of the carrier element part supported in the guide groove is changed.

The 3D free-form bending of a profile with constant outside dimensions over its length is achieved in that the profile can be turned about its longitudinal axis relative to the stationary position of the bending sleeve by means of the rotary drive acting upon the profile. When bending profiles with a non-circular cross section, the guide element is also axially turned in its receptacle unit and the bending sleeve is axially turned in the carrier element, particularly due to a positive fit. However, when processing profiles with a circular cross section, the guide sleeve and the bending sleeve may also be rigidly connected to their respective receptacles. Since the profile is turned, the bending plane also remains unchanged after a change in the bending direction. The device may have a comparatively simple design since it can be realized in the form of an add-on unit for a 2D drawing/bending machine. The movement of the bending sleeve for adjusting the bending radius takes place in one plane and can be coupled, for example, with the movement of the bending table of a drawing/bending machine. Consequently, important components of a conventional drawing/bending machine can still be utilized. Facilities that are already equipped with drawing/bending machines for 2D-bending processes can be converted into 3D profile bending facilities without having to invest in completely new machines. The positioning drive for the bending sleeve can be inexpensively realized with a minimal number of movable parts due to the eccentrically pivoted support of the carrier element with the bending sleeve about the hinge point of a rocker. In this case, the installation and control of linear drives for displacing the carrier element in two directions in space can be completely eliminated.

A compact design of the device according to the invention can be achieved if the guide element is realized in the form of a guide sleeve that can be turned about the longitudinal axis of the profile. In this case, it is particularly advantageous to longitudinally divide the guide sleeve. If the guide sleeve is divided, for example, into two halves, the clearance between the profile and the guide sleeve and consequently between the profile and the bending sleeve can be completely eliminated. In comparison with the state of the art, this makes it possible to bend profiles with a particularly small bending radius.

The profile cross section can also be altered in a targeted fashion before the bending process if the through-opening of the guide element has a cross-sectional shape that essentially changes continuously in the feed direction, namely such that the guide element acts upon the profile as the shaping tool. The guide element may be provided, for example, with shaped elements that are inserted into its through-opening for this purpose. Slight changes in the cross-sectional shape can be achieved in the cold state. If more significant changes in the cross-sectional shape are required, it is practical to provide the guide element with a heater for heating the profile. It goes without saying that the heating device also promotes the bending of profiles with a small bending radius if the cross-sectional shape is constant.

According to one advantageous embodiment of the invention, the edges of the through-opening of the guide sleeve are rounded on the inlet side and/or the outlet side. This simplifies the insertion of the profile into the bending sleeve during the preparation of the bending process.

The device according to the invention also is particularly suitable for bending hollow profiles with variable bending radii. When bending profiles with small bending radii, the device contains a bending block that supports the inside of the hollow profile during the bending process. This effectively prevents the hollow profile from collapsing, in particular, when bending the profile with small bending radii, and the formation of wrinkles in the bent region is reduced.

One prerequisite for obtaining a uniform bending result in accordance with the adjusted bending radius while simultaneously minimizing the tensions occurring in the profile to be bent is the tangential alignment of the inner surface region of the bending sleeve that acts upon the outside of the profile in a bending fashion relative to a circular arc that corresponds to the bending radius. Depending on the cross-sectional geometry and the wall thickness of the profile relative to the enclosed cross-sectional surface, the bending does not begin at the outlet of the guide element, but rather in the guide element if no bending block is utilized as an internal support for the profile to be bent. This causes a displacement of the circular arc opposite to the feed direction. In this case, the continued tangential alignment of the bending sleeve relative to the displaced circular arc is achieved by realizing the progression of the guide groove such that it can be adjusted relative to the longitudinal axis of the profile.

In addition to the bending process, a plastic torsion of the profile about its longitudinal axis can be realized by providing the bending sleeve with a rotary drive. In this case, the bending sleeve and the profile to be bent are collectively turned about the longitudinal axis of the profile by means of the rotary drive while a corresponding rotation of the guide sleeve is prevented by means of a suitable blocking mechanism. For example, the rotary drive may be integrated into the carrier element.

The bending sleeve may be designed differently with respect to the adaptation of the sleeve opening to the cross section of the respective profile to be bent. For example, the bending sleeve may completely enclose the profile. A particularly variable utilization can also be achieved with a U-shaped bending sleeve.

Analogous to the guide sleeve, the insertion of the profile into the bending sleeve can be simplified by rounding the edges of the bending sleeve on the inlet side and/or the outlet side. During the insertion of the profile and during the operation of the device, the bending sleeve needs to be adequately secured against the axial thrust exerted by the profile. The fact that the inner surface of the bending sleeve contains, referred to the feed direction, a linear region or a region with a slight concave curvature also assists in achieving a bending result that exactly corresponds to the respective specifications. If the profile to be bent consists of a hollow profile with a circular outer contour, this region should amount to=⅕ of the profile diameter.

In order to additionally minimize the formation of wrinkles during the bending process, it is practical to arrange a shaped element with an adapted through-opening that sectionally corresponds to the cross section of the profile between the guide element and the bending sleeve, particularly coaxial to the guide element such that it acts upon the profile as a device for smoothing out wrinkles. When bending hollow profiles, this element is used as a supplement to the previously described bending block such that the bending radius can be additionally reduced. Depending on the respective application, this element may be rigid or flexible. When bending a profile with a circular outer contour, it is sensible to realize this element with an annular shape. According to one particularly advantageous embodiment of the invention, this element is realized in the form of an extension of the guide element in the direction of the bending sleeve. It would also be conceivable to realize this element in the form of an extension of the bending sleeve in the direction of the guide element. In both instances, it is practical to realize the shaped element in a U-shaped fashion such that the lateral flanks of the profile are supported during the bending process. A flexible variation of the shaped element may be realized in the form of a coil spring or manufactured from an elastic rubber material, for example, a synthetic elastomer.

BRIEF DESCRIPTION OF THE DRAWINGS

The invention is described in greater detail below with reference to the embodiment illustrated in the figures.

The individual figures show.

DETAILED DESCRIPTION OF THE INVENTION

Figure 2:
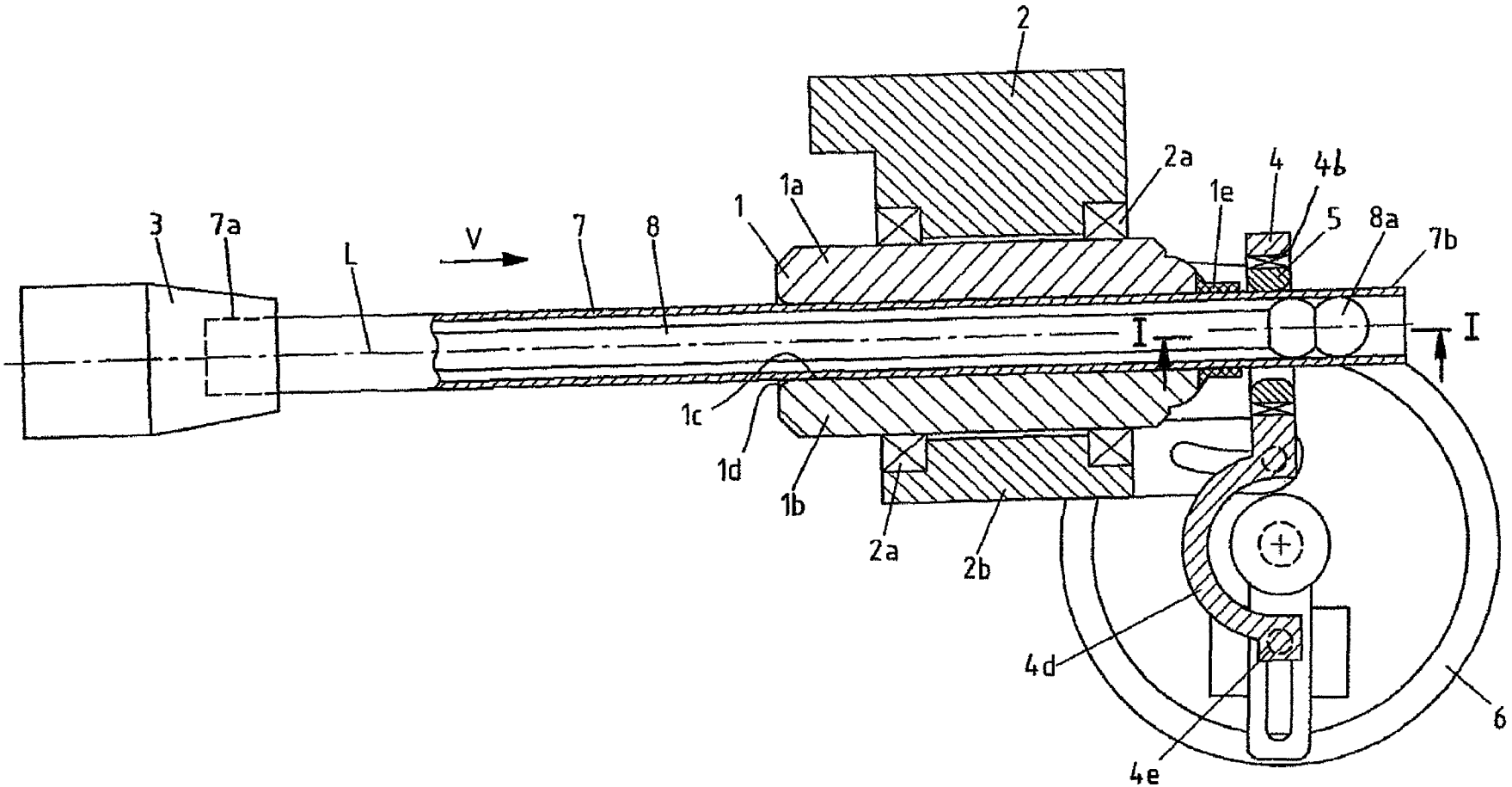
FIG. 2, a longitudinal section through the device according to FIG. 1.

The bending device contains a guide element 1 in the form of a guide sleeve that is supported in a stationary receptacle block 2 by means of two bearings 2*a*, namely such that it can be turned about its longitudinal axis L. This rotation can be prevented by means of a not-shown blocking mechanism. The guide element 1 is also longitudinally divided into two sleeve halves 1*a*, 1*b*. These two sleeve halves collectively form a through-opening 1*c* that is adapted to the shape of the profile and has a rounded edge 1*d* on the inlet side. Referred to the feed direction V of a profile 7 to be bent with a longitudinal axis L, particularly a hollow profile, a shaped element 1*e* (see FIG. 2) that is also realized in a sleeve-shaped fashion and manufactured from an elastic rubber material is arranged downstream of the sleeve halves 1*a*, 1*b*. This shaped element is also adapted to the cross-sectional shape of the profile 7 and rigidly connected to the lower sleeve half 1*b*. In addition, the bending device contains a feed unit 3 that is realized in the form of profile tongs and serves for seizing the profile 7 on its rear end 7*a* referred to the feed direction V. The feed unit 3 can be displaced in a feed direction V by means of a not-shown linear drive. In addition, the feed unit 3 is provided with a not-shown rotary drive for turning the feed unit 3 and the profile 7 about the longitudinal axis L.

Figures 3, 4:
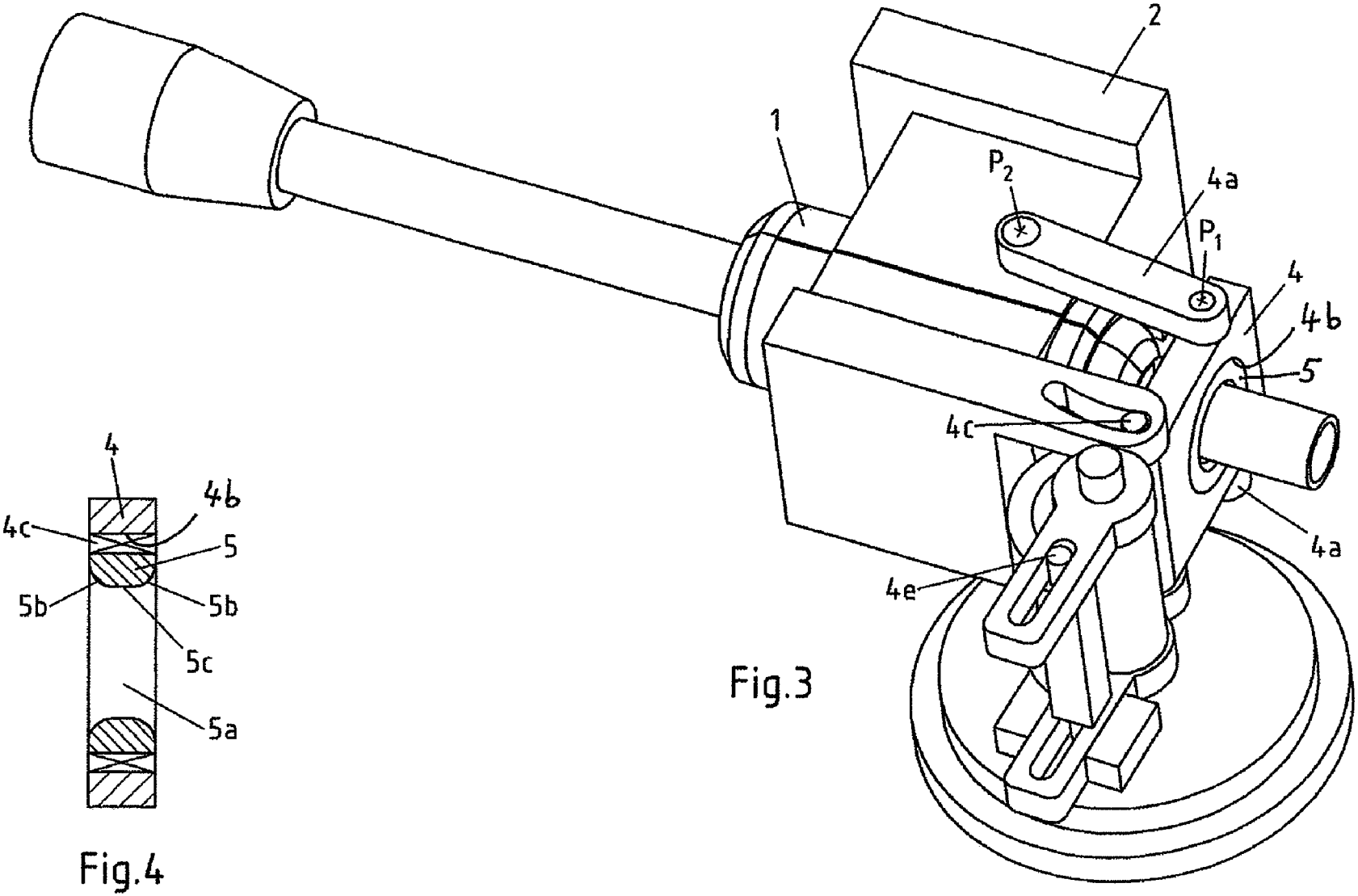
FIG. 3, a perspective representation of the device according to FIG. 1, and FIG. 4, a detailed cross section through the device according to FIG. 1 along the line I-I in FIG. 2.

A carrier element 4 in the form of a carrier plate is arranged downstream of the guide element 1 and the shaped element 1*e* referred to the feed direction V and connected to the stationary receptacle block 2 by means of two parallel rockers 4*a* (see FIG. 3). In this case, the carrier element 4 is rotatably supported in the rockers 4*a* and the rockers 4*a* are rotatably supported in the receptacle block 2. This means that the carrier element 4 and the rockers 4*a* collectively form a coupling gear. The carrier element 4 contains a round opening 4*b*, in which an inserted bending sleeve 5 is rotatably supported by means of a bearing 4*c* (see FIG. 4). In addition, the bending sleeve 5 is supported by the carrier element 4 such that it can be eccentrically pivoted about two hinge points $P_1$ of the rockers 4*a* that are arranged on an axis extending perpendicular to the longitudinal profile axis L. The rockers 4*a* are supported such that they can be respectively pivoted about a second hinge point $P_2$ that is arranged eccentric referred to the longitudinal profile axis L on the same side of the profile. A not-shown rotary drive for turning the bending sleeve is integrated into the carrier element 4. The inside cross section 5*a* of the bending sleeve 5 is also adapted to the shape of the profile 7 to be bent, particularly square or circular, but larger than the through-opening 1*c* in the guide element 1. The edges 5*b* of the through-opening in the bending sleeve 5 are rounded on the inlet side and the outlet side in order to simplify the insertion of the profile. In addition, the inner surface of the bending sleeve 5 contains a linear region 5*c* referred to the feed direction V (see FIG. 4).

A fork-shaped boom 2*b* with a curved guide groove 2*d* machined into its respective branches 2*c* is mounted on the receptacle block 2. The carrier element 4 is displaceably supported in the guide grooves 2*d* of the boom 2*b* by means of outwardly directed guide pins 4*c*. An adjusting arm 4*d* extending around the extended axis of rotation 6*a* of a disk-shaped bending table 6 is also rigidly connected to the carrier element 4. The bending table 6 may form part of a conventional drawing/bending device. Two outwardly directed guide pins 4*e* are also arranged on the end of the adjusting arm 4*d*. These guide pins engage into guide grooves 6*c* machined into two parallel boom arms 6*b*. The boom arms 6*b* are rigidly connected to the axis of rotation 6*a* of the bending table 6 with one end and consequently can be adjusted together with the bending table 6 by means of its not-shown rotary drive.

The bending device according to the invention functions as described below:

The hollow profile 7 to be bent is firmly clamped in the feed unit 3 with its end 7*a*. A bending block 8 inserted into the hollow profile 7 is guided by the feed unit 3 and fixed downstream thereof by means of a not-shown stationary mounting element. This bending block consists of a flexible front block section 8*a*, particularly a bead chain for a pipe with circular cross section, and a not-shown rear grip head that axially holds the bending block 8. The bending block 8 serves for preventing the profile 7 from collapsing and from excessively developing wrinkles during the course of the bending process. This is achieved in that its block section 8*a* adjoins and supports the inside of the hollow profile 7. When processing an angular hollow profile, e.g., a pipe with square cross section, the block section naturally needs to have a corresponding cross-sectional shape.

When preparing for the bending process, the hollow profile 7 is moved into the guide element 1 by the linear drive of the feed unit 3 that takes hold of the hollow profile 7 on its rear end 7*a*. The rounded edge 1*d* on the inlet side of the through-opening 1*c* of the guide element 1 simplifies this insertion process. Due to the correspondingly chosen inner cross-sectional shape of the through-opening 1*c*, the guide element 1 adjoins the hollow profile 7 with a positive fit. Before the bending process is initiated, the carrier element 4 is in a starting position I, in which the bending sleeve 5 is aligned with the guide element 1. The hollow profile 7 is now moved through the guide element 1 and the shaped element 1*e* to such a degree that its opposite end 7*b* referred to the feed unit 3, at the height of which the block section 8*a* of the inserted bending block 8 is situated, slightly protrudes over the bending sleeve 5.

Figure 1:
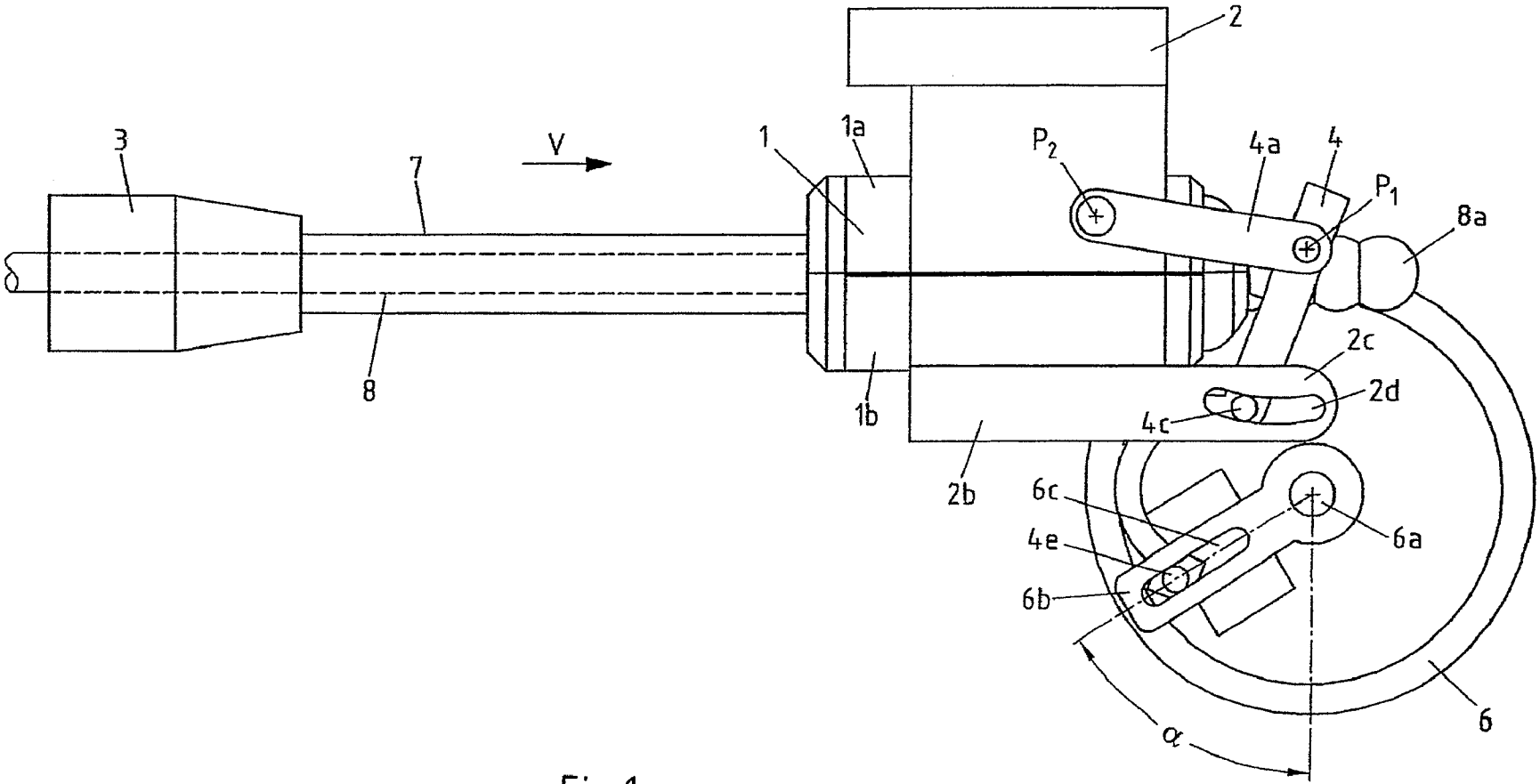
FIG. 1, a side view of a device for the 3D free-form bending of profiles with a hollow profile inserted therein immediately before the bending process begins.

When initiating the bending processes in initially one plane (2D bending), the boom arms 6*b* are turned in the clockwise direction by an angle $\alpha$ together with the bending table 6, namely while the hollow profile 7 is moved with a constant feed rate and the bending block 8 is axially held in position. The carrier element 4 follows this movement under the influence of its adjusting arm 4*d*, wherein the guide pins 4*e* travel radially outward in their assigned guide groove 6*c*. The carrier element 4 is pivoted relative to the feed direction V of the hollow profile 7, wherein said pivoting movement is composed of a rotational movement and a translational movement, at least one component of which extends perpendicular to the profile axis L. Once the pivoting of the boom arms 6*b* by the angle $\alpha$ is completed, the carrier element 4 is situated in a position II, in which it is turned further in the clockwise direction than in FIGS. 1 and 2. Analogous to any other possible position, this position is uniquely defined by the respective position of the guide pins 4*c*, 4*e* in the guide grooves 2*c* machined into the boom ends 2*b*, as well as by the position of the carrier element 4 relative to the rockers 4*a*. In this context, each position of the carrier element 4 corresponds to a specific bending radius. Consequently, the desired bending radius can be easily adjusted by choosing the turning angle $\alpha$ accordingly.

When initiating the 3D free-form bending, i.e., a change of the bending direction and a change of the bending plane, the feed movement is stopped and the hollow profile 7 is turned by the desired angle with the aid of the rotary drive connected to the profile collet chuck 3. The guide element 1 that is rotatably supported in the receptacle block 2 and the bending sleeve 5 that is rotatably supported in the carrier element 4 participate in this turning movement. In contrast to the state of the art, the profile 7 to be bent does not have to be strictly rotationally symmetrical in order to be subjected to a 3D free-form bending process on a device according to the invention.

While the hollow profile 7 is turned by the feed unit 3, the already bent section of the hollow profile 7 is turned out of the defined bending plane of the bending device, and the adjacent hollow profile 7 section that is advanced once the feed movement commences is bent in the bending plane in a spatially unchanged fashion. During this process, the profile section situated at the height of the bending sleeve 5 when the hollow profile 7 is turned also moves out of the bending plane. This can be achieved without having to adjust the bending sleeve 5, namely because the through-opening 5*a* of the bending sleeve 5 includes a certain lateral clearance in addition to the outside dimensions of the profile 7 such that sufficient free space is available for the profile 7.

If a profile with non-circular cross section not only needs to be bent, but also subjected to a superimposed torsion, the guide element 1 is blocked with the aid of the blocking mechanism, and the bending sleeve 5 is turned in a defined fashion. However, the bending plane cannot be changed in this case.

If it is also necessary to change the bending radius, the position of the carrier element 4 that holds the bending sleeve 5 is also changed in the previously described fashion by turning the boom arms 6*b* together with the bending table 6.

The invention claimed is:

1. A device for the 3D free-form bending of profiles with constant outside dimensions over their length, particularly with a circular shape, wherein said device comprises a feed unit that contains a rotary drive for turning the profile about its longitudinal axis and serves for moving the profile with a longitudinal axis in a feed direction that extends parallel to this longitudinal axis, namely through a guide element with a through-opening that adjoins the surface of the profile and a bending sleeve that at least partially encloses the profile to be bent and is arranged downstream of the guide element referred to the feed direction, wherein said bending sleeve is held in a carrier element and can be pivoted about an axis that extends perpendicular to the feed direction of the profile, as well as displaced perpendicular to the longitudinal axis and the pivoting axis, together with said carrier element such that the bending sleeve acts upon the profile in a bending fashion, wherein a) the guide element supports the profile such that it can be turned about the longitudinal axis in or with the guide element, b) the bending sleeve supports the profile such that it can be turned about the longitudinal axis in or with the bending sleeve, c) the bending sleeve is supported such that it can be eccentrically pivoted about a first hinge point of a rocker by means of the carrier element, wherein the rocker, in turn, is supported such that it can be pivoted about a second hinge point that is arranged eccentric to the longitudinal axis of the profile on the same side of the profile as the first hinge point, and d) the carrier element is held in a guide groove on the opposite side of the profile referred to the hinge points, namely such that the inner surface region of the bending sleeve that acts upon the outside of the profile in a bending fashion is, discounting the resilience of the profile, always aligned tangential referred to a circular arc that corresponds to the respectively desired bending radius when changing the position of the part of the carrier element that is supported in the guide groove.

2. The device according to claim 1, wherein the rotatably supported guide element is realized in the form of a guide sleeve.

3. The device according to claim 2, wherein the guide sleeve is longitudinally divided.

4. The device according to claim 1, wherein the through-opening of the guide element has a cross-sectional shape that essentially changes continuously in the feed direction such that the guide element acts upon the profile as a shaping tool.

5. The device according to claim 1, wherein the guide element contains a heating device for heating the profile.

6. The device according to claim 1, wherein the edges of the through-opening of the guide sleeve are rounded on the inlet side and/or the outlet side.

7. The device according to claim 1, wherein when bending hollow profiles, the device contains a bending block for internally supporting the hollow profile during the bending process.

8. The device according to claim 1, wherein the progression of the guide groove relative to the longitudinal axis of the profile is adjustable.

9. The device according to claim 1, wherein the bending sleeve contains a rotary drive.

10. The device according to claim 1, wherein the bending sleeve completely encloses the profile.

11. The device according to claim 1, wherein the bending sleeve is realized in a U-shaped fashion.

12. The device according to claim 1, wherein the edges of the bending sleeve are rounded on the inlet side and/or the outlet side.

13. The device according to claim 1, wherein the inner surface of the bending sleeve contains a linear or slightly concave region referred to the longitudinal direction of the profile.

14. The device according to claim 13, wherein the linear or slightly concave region amounts to =⅕ of the profile diameter when bending a hollow profile with circular cross section.

15. The device according to claim 1, wherein a shaped element with an adapted through-opening that sectionally corresponds to the cross section of the profile is arranged between the guide element and the bending sleeve, namely such that it acts upon the profile as a device for smoothing out wrinkles.

16. The device according to claim 15, wherein the shaped element is realized in the form of an extension of the guide element in the direction of the bending sleeve.

17. The device according to claim 15, wherein the shaped element is realized in the form of an extension of the bending sleeve in the direction of the guide element.

18. The device according to claim 15, wherein the shaped element is realized in the form of a coil spring, a metal ring or an elastomer ring.

* * * * *